United States Patent [19]

Sciortino et al.

[11] Patent Number: 4,854,247

[45] Date of Patent: Aug. 8, 1989

[54] LOCK TYPE SEALED PAPER CURRENCY COLLECTOR AND SECURITY DEVICE

[75] Inventors: Michael J. Sciortino; Wendel Schmidt, both of Mt. Prospect, Ill.

[73] Assignee: Glenview Security Systems, Inc., Glenview, Ill.

[21] Appl. No.: 110,374

[22] Filed: Oct. 19, 1987

[51] Int. Cl.[4] ..... E05G 3/00; B65H 5/22; B65H 1/00

[52] U.S. Cl. ..... 109/1 R; 109/24.1; 109/52; 194/206; 271/3.1; 271/145; 271/207

[58] Field of Search ..... 109/2, 19, 24.1, 39, 109/44, 45, 50–53, 59 R; 194/206, 207; 271/3.1, 145, 207

[56] References Cited

U.S. PATENT DOCUMENTS 4,510,380 4/1985 Uchida et al. ..... 194/206
4,552,075 11/1985 Glasson et al. ..... 109/52
4,655,368 4/1987 Bateman et al. ..... 109/52
4,678,072 7/1987 Kobayashi et al. ..... 194/206

*Primary Examiner*—Neill R. Wilson
*Attorney, Agent, or Firm*—Silverman, Cass, Singer & Winburn, Ltd.

[57] ABSTRACT

A lock type sealed security device or unit for clamping bills accumulated in vending machine validating or other paper currency accumulating devices. The device is locked onto the accumulating device in a position which allows the currency to be accumulated therein. When the currency is desired to be removed, the device is moved into a clamping position and operated to securely clamp the sheaf of paper currency therein. The security device can be unlocked from the validating device only when the currency is clamped and an unclamped sealed security device can be mounted in its place on the validating device. The security device with the currency clamped therein then is removed to a collection area, where the device is unsealed and the currency is unclamped and removed.

18 Claims, 4 Drawing Sheets

FIG. 1
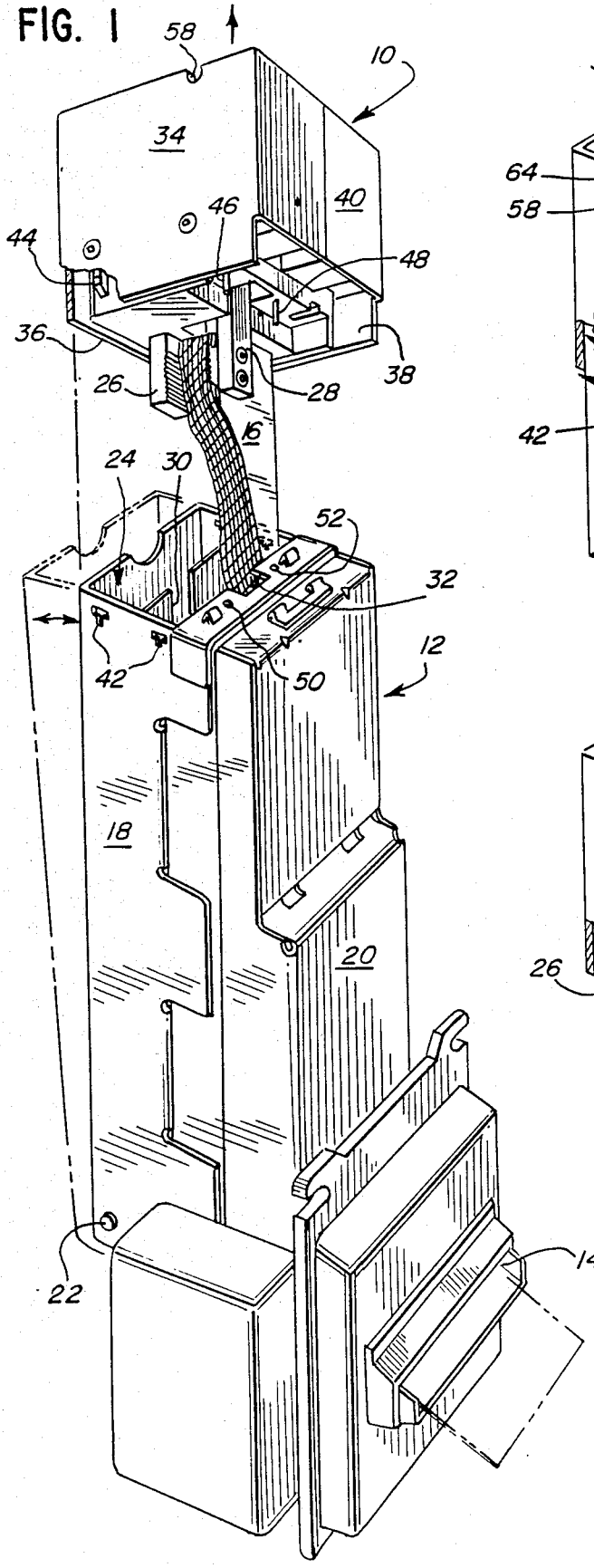
FIG. 2
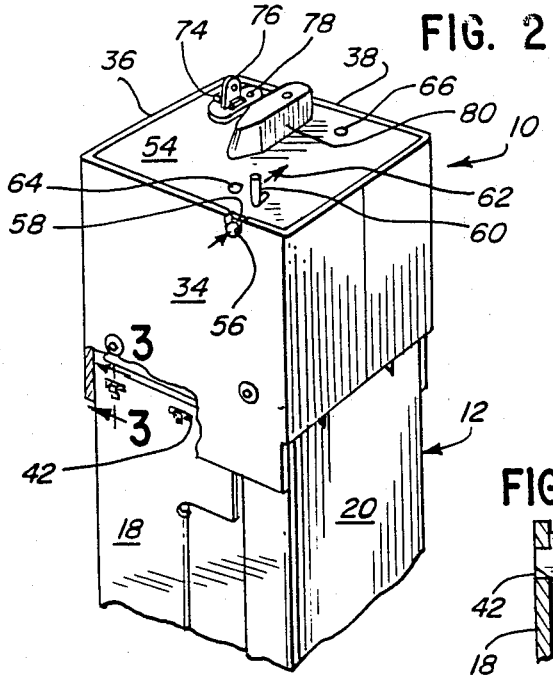
FIG. 3
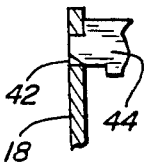
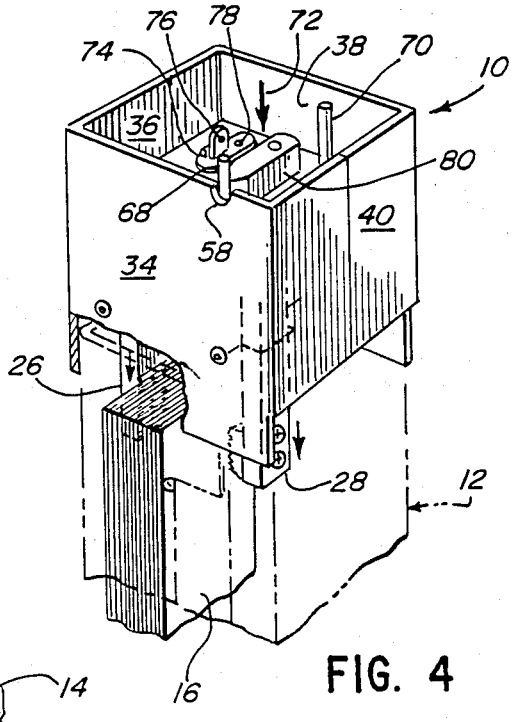
FIG. 4

FIG. 5
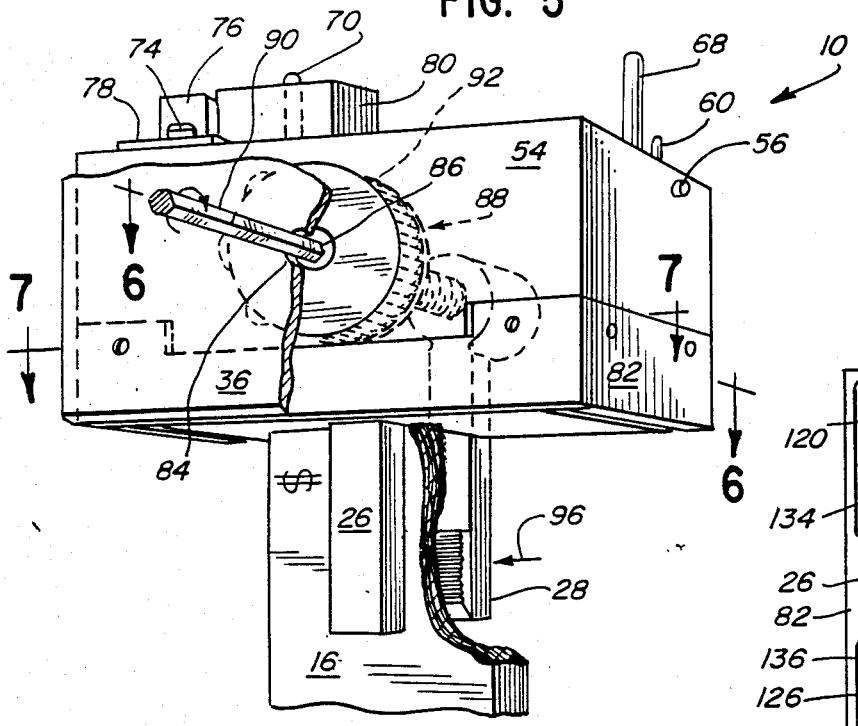
FIG. 7
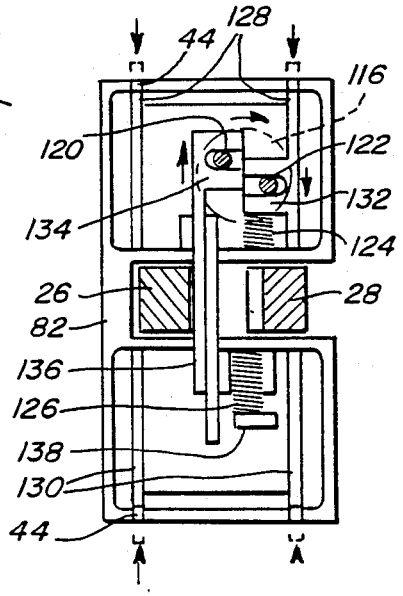
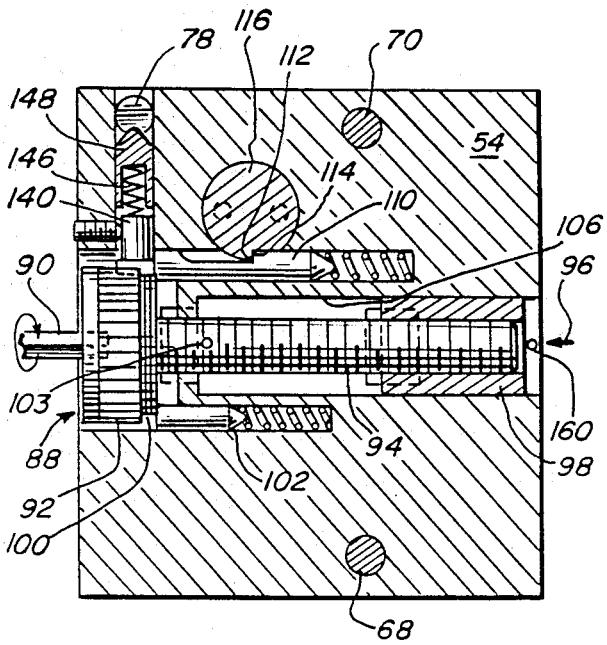
FIG. 6A
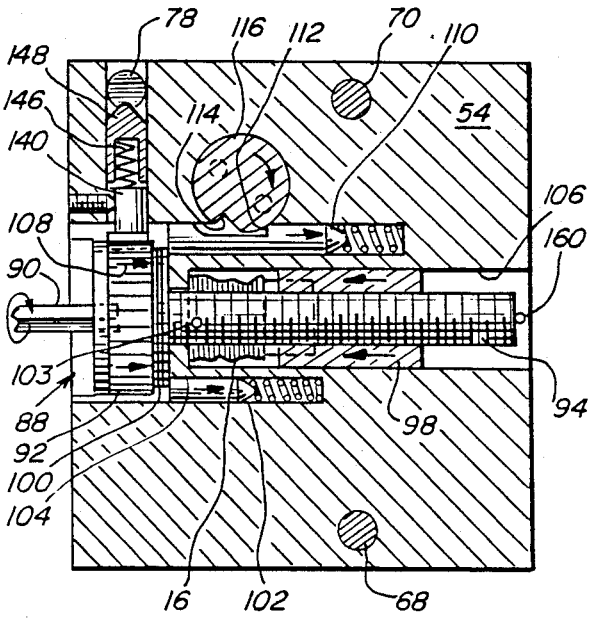
FIG. 6B

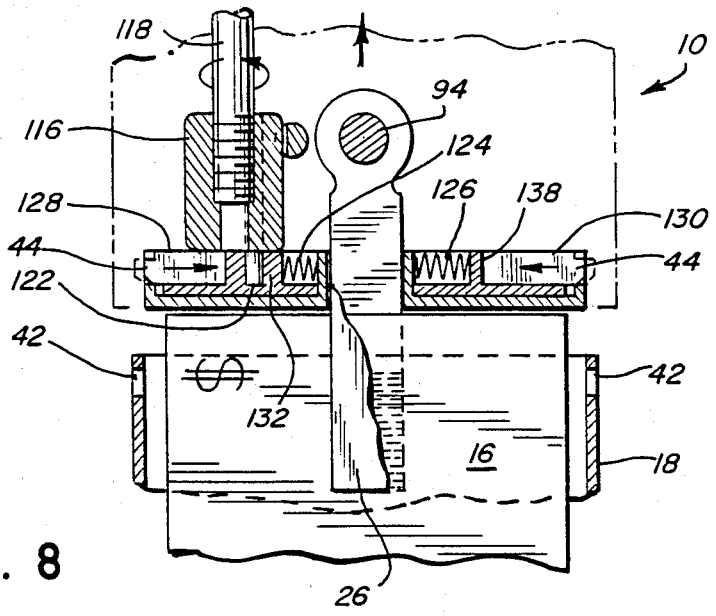
FIG. 8
FIG. 9A
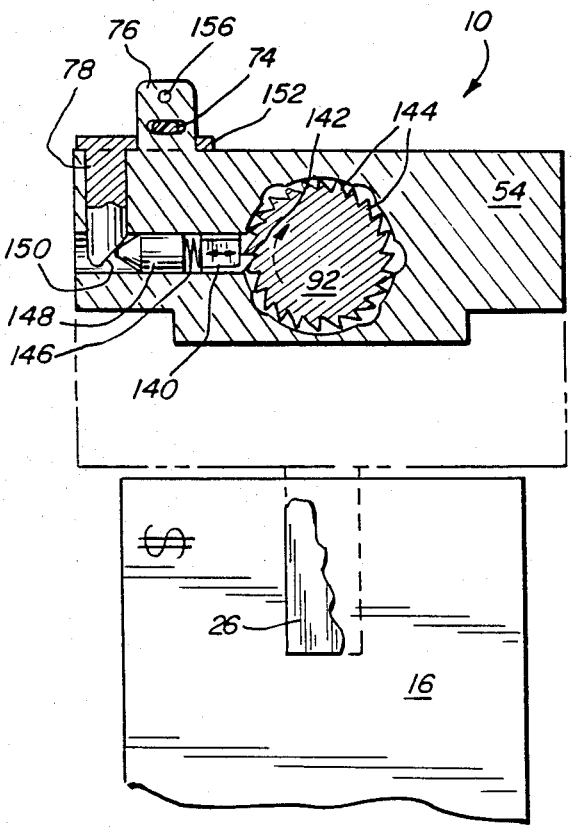
FIG. 9B
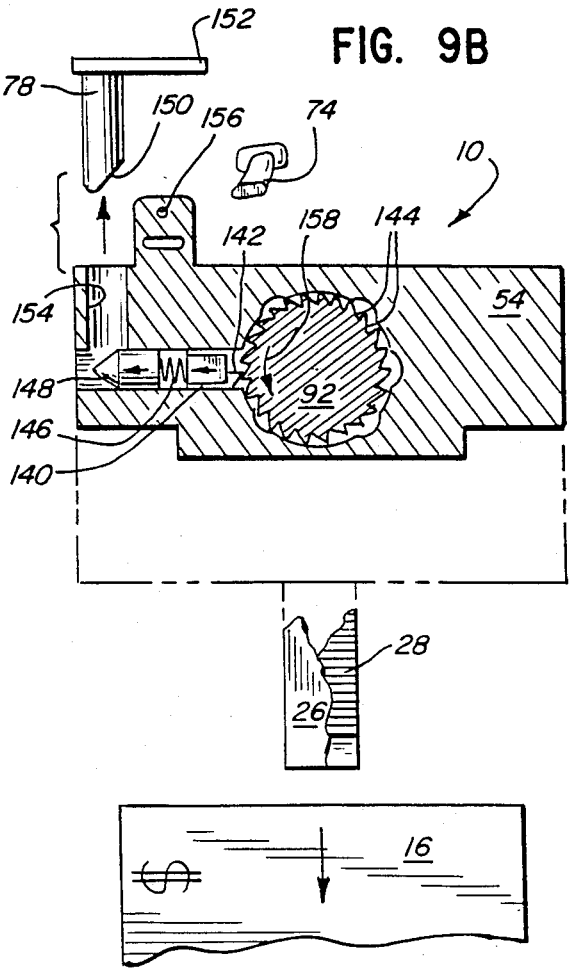

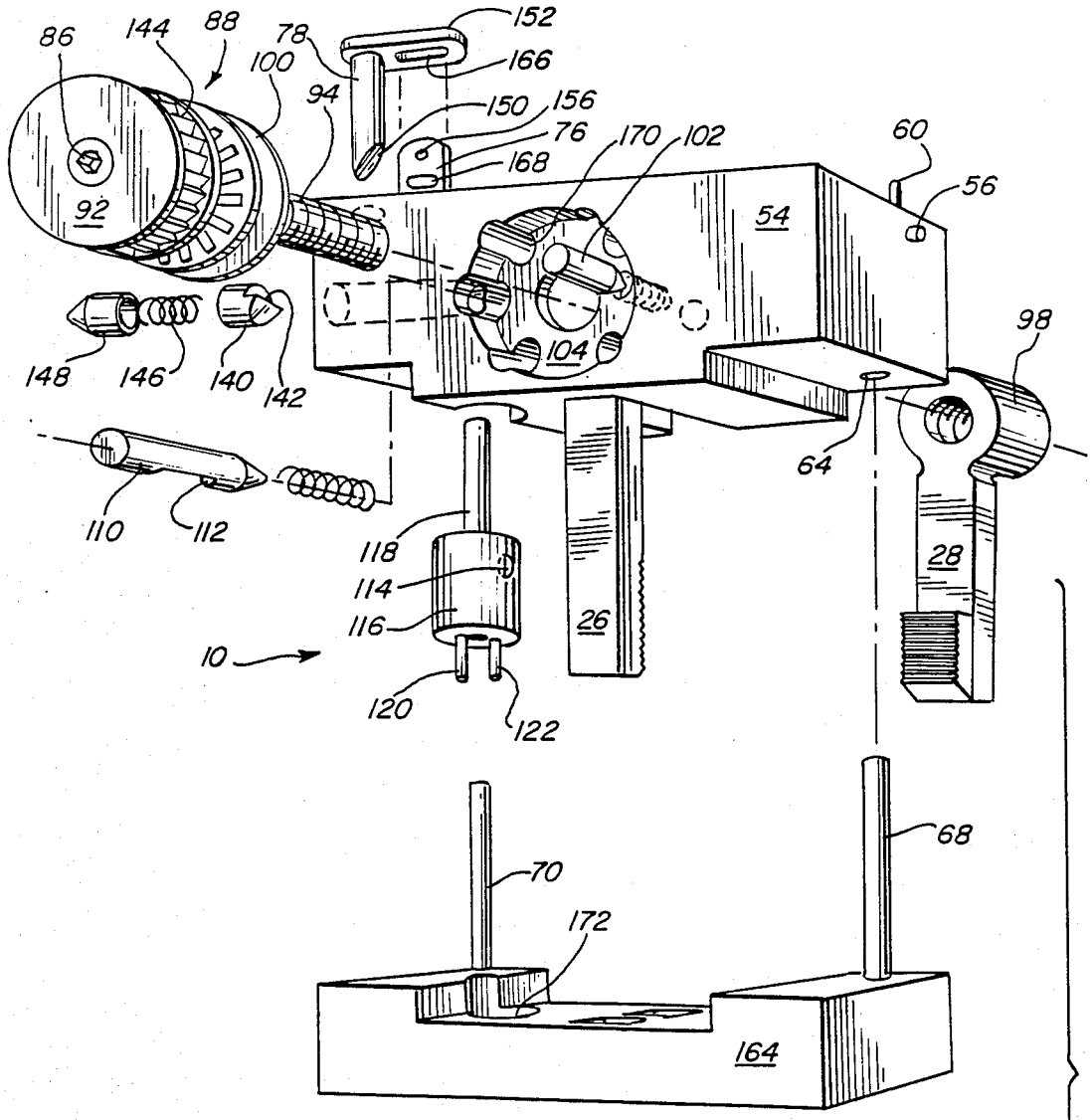
FIG. 10
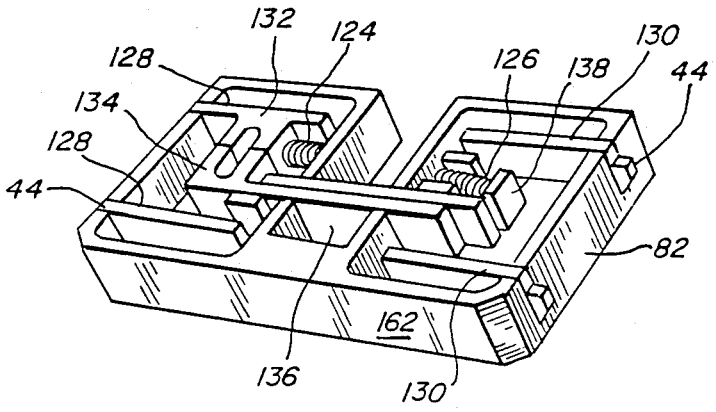

LOCK TYPE SEALED PAPER CURRENCY COLLECTOR AND SECURITY DEVICE

BACKGROUND OF THE DISCLOSURE

This invention relates generally to a system for collecting and securing paper currency and more particularly to a lock type sealed collector and security device which is attached to vending machine paper currency validators.

Vending machines commonly are operated by coins and normally have coin containers or receptacles to receive the coins placed into the machine by purchasers of the merchandise in the machines. When the machines are serviced, the serviceman removes the loaded coin container, empties it and replaces it within the machine.

Because of the significant cash loss from vending machine collections, it has become customary to provide a locked coin container, which is removed in the locked condition and remains so until returned to an authorized counting station where it then can be opened and the coins removed.

Recently vending machines have been provided which are operable with paper currency. Such machines include a paper currency validating and collecting device, which insures that the correct paper currency denomination has been received and that it is a valid (hence validator) bill. One such validator, utilized as the example herein, is manufactured by the Money Systems Division of Mars Electronics in West Chester, Pa. The validators collect the paper currency, but the serviceman unlocks the validator and removes the currency during servicing without any security.

It thus would be desirable to provide a security device for such unsecured paper currency validators or other types of accumulators.

SUMMARY OF THE INVENTION

The above and other disadvantages of prior art paper currency collecting systems are overcome in accordance with the present invention by providing a lock type sealed security device which clamps the bills in a manner such as to prevent removal thereof. The security device is attached to the prior art validating systems and removed therefrom with the currency clamped therein to prevent pilferage during servicing or collections.

The security device is mounted and locked onto the accumulator out of the operative path of the validating system until collections are desired. The sealed security device then is moved to an operative position to clamp the bills, after which it can be removed from the validating system and an empty security device then is mounted into the validating system. The sealed security device is removed to a collection area, where the seal is removed and the paper currency then can be unclamped and removed.

BRIEF DESCRIPTION OF THE DRAWINGS

FIG. 1 is a exploded perspective view of one embodiment of the sealed security device of the invention mounted onto a prior art validating system;

FIG. 2 is a partial perspective view of the device and system of FIG. 1 in the validating system operative position;

FIG. 3 is a partial side sectional view of the locking mechanism which locks the security device to the validating system taken along the line 3—3 of FIG. 2;

FIG. 4 is a partial perspective view of the device and system of FIG. 1 in the security device clamping position;

FIG. 5 is a partial perspective view of the device of FIG. 1 illustrating the clamping operation;

FIGS. 6A and 6B are two different operative sectional views of the device of FIG. 5 taken along the line 6—6 therein;

FIG. 7 is a top view of the device spring loaded locking members of FIG. 5 taken along the line 7—7 therein;

FIG. 8 is a partial side sectional view of the device of FIG. 1;

FIGS. 9A and 9B are partial side sectional views of the device of FIG. 1 illustrating the removal of the seal; and FIG. 10 is an exploded perspective view of the device of FIG. 1.

DESCRIPTION OF THE PREFERRED EMBODIMENTS

Referring to FIG. 1, one embodiment of the lock type sealed paper currency collecting and security device of the invention is designated generally by the reference numeral 10. The device or unit 10 is designed to be mounted on the top end of a currency accumulator, such as a prior art validator 12. The validator 12 is mounted inside of a vending machine (not illustrated) and includes a slot 14 for the insertion of paper currency therein.

The validator 12 validates the currency and stores it in a vertical stack or sheath 16 in a magazine 18. The magazine 18 is pivotally mounted to a fixed body 20 of the validator 12, such as by a pin 22. The validator 12 as illustrated, has been modified to accept the device 10 mounted on the upper end thereof.

The validator 12 has been modified by removal of a top plate or cover (not illustrated) to provide access to an inside portion 24 of the magazine 18. The device 10 includes a pair of currency clamping jaws 26 and 28, which are illustrated clamped on the currency stack 16, partially removed from the magazine 18. The inside 24 of the magazine 18 includes a pair of slots or relief portions 30 and 32, provided to accommodate the jaws 26 and 28 when the device 10 is lowered into the magazine 18.

The device 10 has outer walls 34, 36, 38 and 40 which are dimensioned to fit over the top of the validator 12 when the device 10 is mounted thereon. The validator 12 also is modified to include a plurality of mounting slots or apertures 42 into which spring biased locking arms 44 are engaged when the device 10 is mounted onto the validator 12 (FIG. 3).

The device 10 further includes a pair of locking pins 46 and 48, which fit into mating locking apertures 50 and 52 formed in the top of the validator 12. When the locking pins 46 and 48 are engaged in the apertures 50 and 52, the magazine 18 is locked against pivoting away from the body 20, to secure the device 10 and the validator 12 together.

The device 10 is initially mounted with an inner movable jaw holding member 54 in an upper validator 12 operating position, as illustrated in FIG. 2. In this position, the device 10 is locked onto the validator 12, but the jaws 26 and 28 are in the upper position enabling the validator 12 to operate on the paper currency and store it in the magazine 18. The device 10 is maintained in the upper validator operating position by a positioning in 56, which extends from the holder 54 and is engaged in a retaining notch 58 formed in the upper edge of the wall 34.

The movable jaw holder 54 includes a positioning release lever 60, which is moved in the direction of an arrow 62 retracting pin 56 to release and move the holder 54 into a lower bill clamping and retrieving position (FIG. 4). The holder 54 includes a pair of guide passageways 64 and 66, into which are slidingly engaged a pair of guide rods 68 and 70. The guide rods 68 and 70 assist in maintaining the alignment of the holder 54 as it is moved into the lower position as shown by the arrow 72. In this lower position, the operation of the validator 12 is blocked by the jaws 26 and 28, which now are positioned on opposite sides of the stack or sheaf of bills 16.

The device or unit 10 is sealed by a seal 74, such as a conventional seal, which is sealed at the collection center and is not affected by the mounting, changing of operating position or removal of the device 10. The operation of the seal 74, which is engaged through a seal post 76 and retains a ratchet release pin 78, is described with respect to FIGS. 9A and 9B. The unit 10 is released from the validator 12 after the sheaf of bills 16 is securely clamped between the jaws 26 and 28, by operation of a unit release lever 80, as best described with respect to FIGS. 6A through FIG. 8.

Referring now to FIGS. 5, 6A and 6B, the clamping operation of the device 10 is best illustrated. The movable jaw holder 54 is in the lower clamping position, abuting a lower fixed base unit 82 of the device 10. The wall 36 includes an access aperture of hole 84, which aligns in the lower position with a key aperture 86 in a ratchet and spindle assembly 88. A key 90, of any desired configuration, is inserted into the aperture 86. The key 90 can be turned in only one direction, illustrated as clockwise herein. When the holder 54 is dropped into the lower position, all steps must be performed in sequence prior to removal of the device 10 from the validator 12.

The key 90 turns a ratchet 92 which in turn is mounted onto a threaded spindle 94. The jaw 28 is movable in the direction of an arrow 96 to apply clamping pressure to the sheaf of bills 16. The jaw 28 is mounted onto the spindle 94 with an internally threaded guide member 98 which mates with the spindle threads and which preferably is formed integrally with the jaw 28. The ratchet 92 includes a thrust bearing 100 to permit relatively easy rotation thereof.

The thrust bearing 100 bears against a plurality of bias or pressure setting spring pins 102 mounted in the holder 54 (only one of which is illustrated). The number and magnitude of the spring pins 102 is selected to provide sufficient clamping pressure, such that a bill cannot be pulled from the clamped sheaf 16 without tearing one or more of the individual bills.

The ratchet and spindle assembly 88 is prevented from passing out of the holder 54 in the direction of the arrow 96 by a pin 103 inserted through the spindle 94 and extending from at least one side thereof to bear against a wall 104 formed in one end of a spindle passageway 106.

When the jaw 28 is moved sufficiently in the direction of the arrow 96 to provide the desired clamping pressure, the pressure applied by the spring pins 102 will be overcome and the ratchet 92 now will move in the opposite direction, as illustrated by an arrow 108. When the ratchet 92 and the thrust bearing 100 move in the direction of the arrow 108 compressing the spring pins 102 (only one of which is illustrated), a spring biased release pin 110 is also compressed.

The release pin 110 includes a release notch 112, which mates with a notch 114 formed in a rotational locking member 116 which is mounted on a shaft 118 (FIG. 8) to which in turn is mounted the release lever 80. The notch 112 is formed very precisely to control the release pressure. Once the ratchet 92 has been moved against the wall 104, the sheaf of currency 16 is securely clamped between the jaws 26 and 28.

Only then, can the unit 10 be released from the validator 12. At this fully clamped position, illustrated in FIG. 6B, the member 116 now can be rotated by the lever 80. The member 116 includes a pair of pins 120 and 122 depending therefrom into the base 82, best illustrated in FIGS. 7 and 8.

The pins 120 and 122 actuate the release of the spring biased locking arms or members 44. The arms 44 are biased outwardly by a pair of springs 124 and 126 so the unit 10 will automatically lock into the validator 12 when mounted thereon. Preferably, the arms 44 are secured or formed in pairs 128 and 130. The pair of arms 128 are secured or formed together and one includes a guide bracket 132, into which the pin 122 and against which the spring 124 is engaged.

The pair of arms 130 are secured or formed together and include a guide actuation bracket 134 secured by a guide arm 136 which are secured or formed with the pair of arms 130. The spring 126 is biased against a tab 138 which is attached or formed with the guide arm 136. The pair of arms 128 and 130 are illustrated in the retracted position in FIG. 7, with the member 116 and pins 120 and 122 thereon rotated to release the device 10 from the validator 12. The retraction of the arms 44 unlocks the unit 10 from the apertures 42 in the magazine 18 of the validator 12.

The operation of the ratchet 92 to clamp and release the sheaf of bills 16 is best illustrated in FIGS. 9A and 9B. The ratchet 92 is prevented from rotating in the release or counterclockwise direction by a spring biased ratchet pawl 140. The pawl 140 includes a stop shoulder 142 which engages one of a plurality of ratchet teeth 144, allowing movement only in the clockwise currency clamping direction.

The pawl 140 is biased against the ratchet teeth 144 by a spring 146 and a beveled bias pin 148. The beveled bias pin 148 bears against a beveled shoulder 150 on the end of the ratchet release pin 78. The opposite end of the release pin 78 includes a flange 152 which is spring biased against the seal 74 by a spring pin (not illustrated).

The release pin 78 is slidingly engaged in a passageway 154. When the device 10 is returned from the vending machine with the sheaf of currency 16 clamped between the jaws 26 and 28, an authorized person cuts the seal 74, which allows the pin 78 to move upwardly because of the spring pressure on the flange 152. Although the pin 78 is shown completely removed from the jaw holder 54 (FIG. 9B), it generally will be retained by a stop pin 156 inserted through the upper end of the seal post or tab 76. The movement of the pin 148 and the pin 78 retracts the ratchet stop pawl 140 and allows the ratchet 92 to be reversed as shown by an arrow 158.

The ratchet 92 is reversed until the sheaf of bills 16 is released as illustrated in FIG. 9B. The ratchet 92 further is turned until the ratchet and spindle assembly 88 is returned to the fully open position illustrated in FIG. 6A. The assembly 88 preferably cannot be extended beyond the fully open position, which can be provided by a stop pin 160 (FIG. 6A) against which the guide member 98 will abut in the fully open position. Once in the fully open position, the device 10 is again sealed by a new seal 74.

The various components of the device 10 are best illustrated in the exploded view in FIG. 10. The base 82 includes a bottom portion 162 having the spring biased arms 44 mounted thereon and a top portion 164 having the guide rods 68 and 70 mounted thereon. The flange 152 has an aperture 166 for the spring post 76 and the post has an aperture 168 for the seal 74. A plurality of passageways 170 are provided for the seal pins 102. The top portion 164 includes a through passage 172 to allow the member 116 to be rotatingly inserted therethrough.

Modification and variations of the present invention are possible in light of the above teachings. Although the device 10 has been described with respect to a particular validating device 12 for ease of explanation, the invention can equally be applied to other vending machine validating devices and other paper currency accumulating devices. The outer walls 34, 36, 38 and 40 can be separately or integrally formed. It is therefore to be understood that within the scope of the appended claims, the invention may be practiced otherwise than as specifically described.

What is claimed and desired to be secured by Letters Patent of the United States is:

1. A method of sealingly securing paper currency accumulated into a sheaf in a secured holding or validating device, comprising:

sealingly and lockingly clamping said sheaf of paper currency in a locking device while secured within said validating device;

releasing said sheaf of paper currency and said locking device from said validating device once said sheaf is securely locked and clamped; and unsealing, unlocking and releasing said clamped sheaf of paper currency from said locking device remote from said validating device.

2. The method as defined in claim 1 including providing said locking device with a sealed security unit having means for clamping said sheaf of paper currency therein.

3. The method as defined in claim 2 including mounting and locking said sealed security unit onto said validating device in a first non-clamping position which allows for said paper currency to be accumulated therein.

4. The method as defined in claim 3 including moving said clamping means to a second operative clamping position which blocks further accumulation of said paper currency therein.

5. The method as defined in claim 4 including operating said clamping means in only a first direction to clamp said sheaf of paper currency therein.

6. The method as defined in claim 5 wherein releasing said clamped sheaf of paper currency includes unlocking said sealed security unit from said validating device.

7. The method as defined in claim 5 wherein operating said clamping means include providing a key and rotating said key only in a first direction to clamp said sheaf of paper currency in said clamping means.

8. The method as defined in claim 7 including blocking access of said key in said first non-clamping position of said security unit and providing access in said second operative clamping position.

9. The method as defined in claim 7 including blocking the reverse rotation of said key and release of said clamping means until said security unit is unsealed.

10. A device for sealingly securing paper currency accumulated into a sheaf in a secured holding or validating device, comprising:

means for sealingly and lockingly clamping said sheaf of paper currency in a locking device while secured within the validating device;

means for releasing said sheaf of paper currency and said locking device from said validating device once said sheaf is securely locked and clamped; and means for unsealing, unlocking and releasing said clamped sheaf of paper currency from said locking device remote from said validating device.

11. The device as defined in claim 10 including providing said locking device with a sealed security unit having means for clamping said sheaf of paper currency therein.

12. The device as defined in claim 11 including means for mounting and locking said sealed security unit onto said validating device in a first non-clamping position which allows for said paper currency to be accumulated therein.

13. The device as defined in claim 12 including means for moving said clamping means to a second operative clamping position which blocks further accumulation of said paper currency therein.

14. The device as defined in claim 13 including means for operating said clamping means in only a first direction to clamp said sheaf of paper currency therein.

15. The device as defined in claim 14 wherein said releasing means include means for unlocking said sealed security unit from said validating device only when said sheaf of paper currency is clamped therein.

16. The device as defined in claim 14 wherein said operating means include a key and means for rotating said key only in a first direction to clamp said sheaf of paper currency in said clamping means.

17. The device as defined in claim 16 including means for blocking access of said key in said first non-clamping position of said security unit and providing access in said second operative clamping position.

18. The device as defined in claim 16 including means for blocking the reverse rotation of said key and release of said clamping means until said security unit is unsealed.

* * * * *